US005879870A

United States Patent [19]

Rosiek et al.

[11] Patent Number: 5,879,870

[45] Date of Patent: Mar. 9, 1999

[54] COLOR PAPER POST PROCESS DMIN KEEPING WITH A BIS-VINYLSULFONYL AS THE HARDENER AND A CHROMANOL STABILIZER

[75] Inventors: Thomas A. Rosiek, Honeoye Falls; Alberto M. Martinez, Rochester; Walter H. Isaac, Penfield, all of N.Y.

[73] Assignee: Eastman Kodak Company, Rochester, N.Y.

[21] Appl. No.: 735,371

[22] Filed: Oct. 21, 1996

[51] Int. Cl.[6] ..... G03C 7/26; G03C 7/32; G03C 1/00

[52] U.S. Cl. ..... 430/546; 430/543; 430/554; 430/555; 430/551; 430/607; 430/621; 430/622; 430/631

[58] Field of Search ..... 430/543, 546, 430/554, 555, 621, 622, 631, 551, 607

[56] References Cited

U.S. PATENT DOCUMENTS

| | | | |
|---|---|---|---|
| 3,359,111 | 12/1967 | Van | 430/621 |
| 3,841,872 | 10/1974 | Burness et al. | 430/621 |
| 4,863,841 | 9/1989 | Okamura et al. | 430/621 |
| 4,874,688 | 10/1989 | Ozawa et al. | 430/546 |
| 5,484,692 | 1/1996 | Mitsui et al. | 430/546 |
| 5,514,535 | 5/1996 | Hamilton et al. | 430/622 |
| 5,658,721 | 8/1997 | Griggs et al. | 430/622 |

FOREIGN PATENT DOCUMENTS

| | | |
|---|---|---|
| 0 327 976 | 8/1989 | European Pat. Off. . |
| 0 530 039 | 3/1993 | European Pat. Off. . |
| 0 539 024 A1 | 4/1993 | European Pat. Off. . |
| 0 575 910 | 12/1993 | European Pat. Off. . |

OTHER PUBLICATIONS

Derwent Abstract, 351, p. 1, Jul. 1, 1996 (EP 327976).

*Primary Examiner*—Geraldine Letscher
*Attorney, Agent, or Firm*—Paul A. Leipold

[57] ABSTRACT

Improvements in post process Dmin are provided in a photographic element that has a preferred coupler, hardener, and permanent solvent. The coupler of the element comprises between about 20 and 40 percent by weight of the coupler and oil phase components and the element further comprises chromanol stabilizer.

12 Claims, No Drawings

COLOR PAPER POST PROCESS DMIN KEEPING WITH A BIS-VINYLSULFONYL AS THE HARDENER AND A CHROMANOL STABILIZER

FIELD OF THE INVENTION

This invention relates to improvements in color photographic paper materials. It particularly relates to improvements in post process discolorations in the low density regions of the color paper.

BACKGROUND OF THE INVENTION

In forming of color paper materials and color negative films, there is a need to provide in the film and paper structures a hardener that will improve the physical properties of the gelatin forming the layers of the photographic materials. The speed of the hardener is important as the more rapidly the hardener works, the quicker the photographic material may be available for use.

In color paper materials the colors are formed by reaction of colorless couplers with oxidized developer. The couplers are combined with permanent solvents and stabilizers prior to color paper formation. The solvents improve the reactivity of the couplers, as well as aiding the dispersion of the couplers in the gelatin. Typical color paper structures are shown in *Research Disclosure* No. 37038, February 1995.

The improvement in print stability of color papers is of continuing interest. Color papers deteriorate by losing whiteness in the white areas such that the white begins to yellow. Another way that the papers illustrate a lack of stability is if the colors fade. The fading of papers and the yellowing of white areas have been at least partially overcome by the provision for more stable dyes and the use of less reactive solvents and less reactive other photographic elements. Further, materials such as antioxidants have been added to photographic print materials to improve their stability.

PROBLEM TO BE SOLVED BY THE INVENTION

In color papers there is a desire to improve the print stability. Print stability has two aspects. One aspect is resistance to fading and the second aspect is the tendency of the low density areas of the print to discolor. Therefore, there is a continuing need for color papers that will harden rapidly and have improved print stability.

SUMMARY OF THE INVENTION

An object of the invention is to provide color photographic print materials that have increased resistance to fade.

A further object of the invention is to provide color photographic print materials that have improved resistance to discoloration in the light areas of the print.

These and other objects of the invention are generally accomplished by providing a photographic element wherein at least one layer comprises a coupler of Formula I Formula I

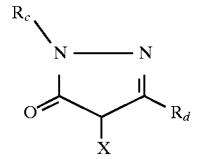

$R_c$ is a substituent; $R_d$ is a substituent; X is hydrogen or a split off group displaceable by oxidized developer;

a hardener of Formula II,

Formula II $$\{CH_2{=}CH{-}X'\}_m{-}Y$$

where

X'=CO, $OSO_2$, $SO_2$, $SO_2NR_2$, and $CONR_2$; where R is hydrogen or alkyl;

Y=C1–C10 alkyl or aryl or substituted C1–C10 alkyl or substituted aryl group;

m=1, 2, 3, or 4;

a permanent solvent of Formula IIIa or IIIb

IIIa $$P(=O)(O{-}R^1)_3$$

wherein:

$R^1$=alkyl or aryl or substituted alkyl or substituted aryl

IIIb

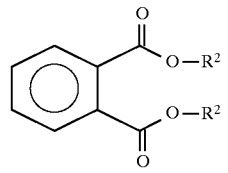

wherein:

$R^2$=alkyl or cycloalkyl or aryl or substituted alkyl or substituted aryl, wherein said coupler of Formula I and solvent of Formula IIIa or IIIb are provided in amounts such that the coupler comprises between about 20 and 40% by weight of the total of the coupler and oil phase components.

In a preferred form of the invention the coupler M-1 and tris(2-ethylhexyl)phosphate permanent solvent are utilized

M-1

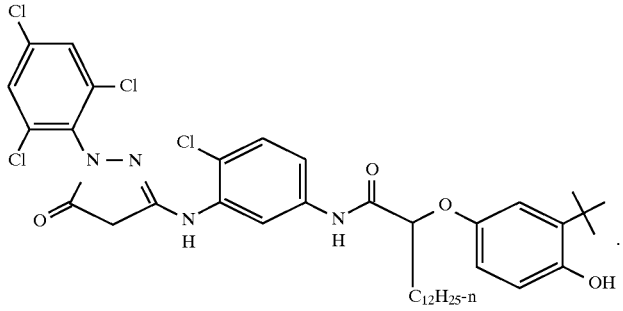

ADVANTAGEOUS EFFECT OF THE INVENTION

The invention has numerous advantages over prior processes and materials. The print materials of the invention have increased resistance to fading upon aging. They are also particularly resistant to discoloration in the low density areas of the print. The invention allows an increased amount of hardener in the photographic material thereby allowing prints to be processed and dried more rapidly as less water will be picked up during processing. The invention provides a photographic element that has increased resistance to scratching during processing. Another advantage of the invention is that the print materials are available for use shortly after formation.

DETAILED DESCRIPTION OF THE INVENTION

The print materials of the invention utilize known couplers in the yellow and cyan layers. The cyan couplers may be any of the typical couplers utilized in formation of color papers. Typical of cyan couplers are those set forth in Section IIA of the *Research Disclosure* No. 37038 of February 1995. The yellow couplers also may be any coupler typically utilized in color papers. Disclosure of typical yellow couplers suitable for the invention are those at Section IIC of *Research Disclosure* No. 37038.

The selection of magenta couplers in accordance with the invention has been found to produce a superior product for image stability. The magenta couplers of the invention have a composition in accordance with Formula I Formula I

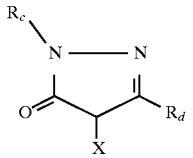

$R_c$ is a substituent; $R_d$ is a substituent; X is hydrogen or a split off group;

A preferred $R_c$ substituent is an aryl group. Preferred $R_d$ substituents are anilino, carbonamide, ureido, carbamoyl alkoxy, aryloxycarbonyl, alkoxycarbonyl, and N-heterocyclic group.

A most preferred magenta coupler structure has been found to be that of

M-1

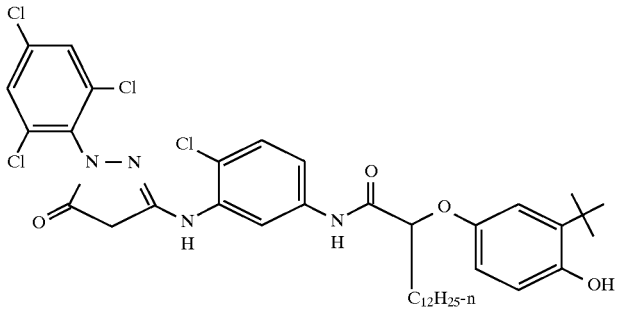

as this coupler provides improved magenta dye stability when utilized with the preferred hardener and solvent of the invention.

The coupler of the invention may be utilized with any of the known permanent solvents for formation of coupler materials. Suitable for the invention are the tritolyl phosphate and dibutyl phthalate. Preferred for the invention is tris(2-ethylhexyl)phosphate, as this has been found to provide a particularly stable magenta dye when utilized with the preferred magenta couplers of the invention.

The permanent solvents of the invention have the general Formulas IIIa and IIIb

IIIa

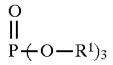

wherein:

$R^1$=alkyl or aryl or substituted alkyl or aryl

IIIb

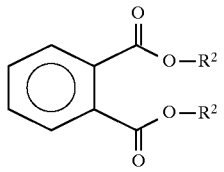

wherein:

$R^2$=alkyl or cycloalkyl or aryl or substituted alkyl, cycloalkyl, or alkyl.

The alkyl group of $R^1$ may be $C_1$ to $C_{18}$. The aryl group of $R^1$ may be a phenyl or naphthyl. The alkyl group of $R^1$ may be substituted with an alkyl group of $C_1$ to $C_4$. The aryl group may be substituted with alkyl groups $C_1$ to $C_5$ which may be primary secondary or tertiary substituents. The aryl group may contain one or more of alkyl groups of $C_1$ to $C_5$.

The alkyl group of $R^2$ may be $C_1$ to $C_{18}$. The aryl group may be phenyl or naphthyl. The alkyl group may be substituted with alkyl groups of $C_1$ to $C_4$. The aryl group may be substituted with alkyl groups $C_1$ to $C_5$ which may be primary secondary of tertiary substituents. The aryl group may contain one or more of alkyl groups of $C_1$ to $C_5$.

The hardeners of this invention are utilized as generally known in the art. The hardener may be added to the layer containing the coupler dispersion or it may be added to another layer and migrate to harden other layers. Examples of hardeners and their use are shown in Section X, *Research Disclosure,* December 1989, Item 308119, published by Kenneth Mason Publications, Ltd., Emsworth, Hampshire, England. Typical useful hardeners include compounds having two or more olefinic bonds, especially unsubstituted vinyl groups bearing electron-withdrawing groups. Suitable are simple vinyl compounds such as Formula II which may be used:

Formula II $$\{CH_2{=}CH{-}X'\}_m{-}Y$$

where

X'=CO, $OSO_2$, $SO_2$, $SO_2NR_2$, and $CONR_2$; where R is hydrogen or alkyl;

Y=C1–C10 alkyl or aryl or substituted C1–C10 alkyl or substituted aryl group;

m=1, 2, 3, or 4.

The preferred hardener is bis(vinylsulfonyl)methane, as this material when utilized in combination with the preferred magenta and permanent solvent provides a photographic structure that is stable, as well as providing abrasion resistance and ability to be shipped rapidly.

Other materials in the color papers of the invention, such as gelatin, and the base paper may be any of those conventional in the art. The base paper generally is a paper sheet that has waterproof polyethylene layers on each side. Further, the papers may be utilized in any conventional layer structure as is typical in the color paper art.

The invention may utilize a paper support that has been treated with polyvinyl alcohol or other oxygen barrier material to provide improved image stability. Treatment may be by addition of an oxygen barrier layer on the paper surface or by impregnation of the paper with an oxygen barrier material. The support paper of U.S. Pat. No. 5,391,473—Lacz et al provides excellent oxygen barrier properties with an oxygen leak rate of less than 25 cc/$m^2$/day. The oxygen barrier substrate such as in U.S. Pat. No. 5,234,804—Sato et al also may be utilized.

The following examples illustrate the practice of this invention. They are not intended to be exhaustive of all possible variations of the invention. Parts and percentages are by weight unless otherwise indicated.

EXAMPLES

Example 1

Multilayer coatings were made as described in coating format 1. To harden the gelatin in these coatings, a comparative hardener (H-1) was coated at a level to equal 1.97 weight percent of the total gelatin. Also in experimental variations, an experimental hardener (H-2) was used at a level equal molar to the comparative hardener. The weight percent of the experimental hardener vs. total coated gelatin was 1.71%. The coatings were processed in color paper Process RA-4. Densities of the unexposed (Dmin) areas of the papers were measured immediately after the RA-4 process. The coatings were then incubated in a dark oven with the temperature controlled at 75° C. and the relative humidity at 50%. After 28 days the coatings were removed and the Dmin densities were again read. The largest gain in density was yellow in appearance and was measured using a Status A blue filter. It was observed that the comparison coatings made with hardener (H-1) had large undesirable gains in blue density. Unexpectedly, the coatings that were made using hardener (H-2) had much smaller gains in blue density. Table 1 describes this result.

TABLE 1

| Coating | Hardener | $D_B$ Dmin Fresh Process | $D_B$ Dmin After 28D/75° C./ 50% RH |
|---|---|---|---|
| Coating Format 1 | H-1 (comparative) | 10 | .27 |
| Coating Format 1 | H-1 (comparative) | 10 | .26 |
| Coating Format 1 | H-2 (invention) | 10 | .20 |
| Coating Format 1 | H-2 (invention) | 10 | .21 |

Example 2

In another experiment coatings were also made in the format described in Coating Format 1, but variations were made to the formula of the coupler containing dispersion in the magenta color forming layer. The comparison coating was made with the identical formula used in Example 1 (MDF-1). An alternative formula (MDF-2) was also coated in which the high boiling organic solvent, dibutyl phthalate, in MDF-1 was replaced with an alternative high boiling solvent, Tris (2-ethylhexyl)phosphate. The other dispersion components were common, but the weight ratios of oil phase components were altered. Table 2 contains a description of MDF-1 and MDF-2.

TABLE 2

| | Relative Weight Ratio (Oil Phase) | |
|---|---|---|
| | MDF-1 | MDF-2 |
| Magenta Coupler (M-1) | 1.0 | 1.0 |
| Dibutyl phthalate | .50 | — |
| Tris(2-ethylhexyl)phosphate | 0 | .964 |
| 2-(2-butoxyethoxy)ethyl acetate | .15 | 162 |
| Stabilizer Compound (ST-1) | .43 | .774 |
| HQ-1 | .10 | .10 |

The coatings were exposed in a stepwise manner on a 1B sensitometer equipped with a WR-99 filter to selectively expose the green sensitive layer of the coating and provide a separation image from the magenta dye forming layer. The density of the coatings was measured using a Status A green filter. The coatings were then exposed to light in a controlled manner. The light intensity was 50 Klux of simulated daylight for 28 continuous days. After treatment, the density of the coatings was measured using a Status A green filter. An advantage in light fastness of the magenta dye formed in the coating with MDF-2 was observed. This is shown in Table 3. Processed coatings from this experiment were also submitted for 75° C., 50% R.H. dark keeping tests for 28 days. The area of minimum density (Dmin) of the processed coatings was read using Status A filters before and after high temperature oven treatment. The results, also contained in Table 3, show a large gain in yellow coloration in the Dmin area, and the coatings with MDF-2 have more yellow coloration than those with MDF-1. Coatings were also made in which hardener H-2 was substituted for hardener H-1 with MDF-2. The amount of yellow Dmin discoloration in the high temperature dark keeping test is unexpectedly improved when hardener H-2 is used.

TABLE 3

| | | 4 wk/50 Klux DL Light Fade | | |
|---|---|---|---|---|
| Coating | Hardener | Green Density Loss From 1.0 | $D_B$ Dmin Fresh Process | $D_B$ Dmin After 28 Days/75° C./50% RH |
| Coating Format 1 (MDF-1) | H-1 comparison | −.66 | .10 | .28 |
| Coating Format 1 (MDF-2) | H-1 comparison | −.49 | .10 | .34 |
| Coating Format 1 (MDF-2) | H-1 comparison | −.46 | .10 | .33 |
| Coating Format 1 (MDF-2) | H-2 invention | −.46 | .10 | .24 |
| Coating Format 1 (MDF-2) | H-2 invention | −.45 | .10 | .24 |

Example 3

In another experiment, coatings were made as described in Coating Format 1, but magenta coupler M-1 was replaced with either magenta coupler M-2 or M-3. The oil phase composition that was used to make coupler dispersions of M-2 and M-3 is described in Table 4. Variations were coated using either hardener H-1 or H-2.

TABLE 4

| | MDF-3 | MDF-4 |
|---|---|---|
| Magenta coupler | 1.0 (M-2) | 1.0 (M-3) |
| Tris(2-ethylhexyl)phosphate | 1.64 | 1.64 |
| Stabilizer compound (ST-3) | 1.05 | 1.05 |
| HQ-2 | .312 | .312 |

The coatings were processed in color paper process RA-4. The low density areas of the coatings was measured using Status A reading filters and then submitted for high temperature dark keeping, 75° C., 50% RH, for 28 days. The samples were then again measured using Status A filters. The largest gain in density after 28 days was yellow in appearance and was measured using a Status A blue filter. Table 5 shows that the coatings with hardener H-2 had smaller increases in density than coatings with hardener H-1.

TABLE 5

| Coating | Magenta Coupler | Hardener | $D_B$ Dmin Fresh Process | $D_B$ Dmin After 28D/75° C./50% RH |
|---|---|---|---|---|
| Coating Format 1 | M-2 | H-1 comparison | .10 | .18 |
| Coating Format 1 | M-2 | H-2 invention | .10 | .17 |
| Coating Format 1 | M-3 | H-1 comparison | .10 | .23 |
| Coating Format 1 | M-3 | H-2 invention | .10 | .20 |

Example 4

An experiment was also coated in Coating Format 2. Variations were made to compare hardener H-1 with hardener H-2. Hardener H-1 was coated at several levels. Coated samples were processed in color paper process RA-4. The low density areas were read using Status A filters. The coatings were then submitted for high temperature dark keeping, 75° C., 50% RH for 28 days. After 28 days the samples were again measured with Status A filters. The largest gain in density was yellow in appearance and was measured using a Status A blue filter. The amount of density gain was reduced when hardener H-2 was used. Hardener H-1 at 2.43% (wt. hardener/wt. of gel) is equivalent in moles to hardener H-2 at 2.107%.

TABLE 6

| Coating | Hardener | % Hardener Based on Total Gel | $D_B$ Dmin Fresh Process | $D_B$ Dmin After 28D/75° C./50% RH |
|---|---|---|---|---|
| Coating Format 2 | H-1 comparison | 2.43% | .10 | .32 |
| Coating Format 2 | H-1 comparison | 2.92% | .10 | .36 |
| Coating Format 2 | H-1 comparison | 3.89% | .10 | .41 |
| Coating Format 2 | H-2 invention | 2.107% | .10 | .19 |

Coated samples of paper that contained equal molar amounts of H-1 or H-2 were also submitted for tests to measure their resistance to scratching during processing, and the rate at which they harden. To measure the scratch resistance, the papers were immersed in a color paper developer solution for 30 seconds at 91° F. A 0.015 inch (radius of curvature) sapphire stylus and a 0.008 inch sapphire stylus were run over the paper applying 10 grams of force for every inch of travel of the stylus. The force necessary to scratch the coating was calculated by measuring the distance until the scratch appears on the coating. The values obtained using the 0.012 inch stylus and the 0.008 inch stylus are averaged, and those data (Table 7) indicate that coatings that contain hardener H-2 have greater resistance to scratch during processing. This advantage is largest in the days immediately after the coating is made.

TABLE 7

| Coating | Hardener | % Hardener Based on Total Gel | Gms to Scribe (.008" + .015")/2 | Days After Coating |
|---|---|---|---|---|
| Format 2 | H-1 comparison | 2.43% | 8 | 1 |
| Format 2 | H-1 comparison | 2.43% | 17 | 2 |
| Format 2 | H-1 comparison | 2.43% | 20 | 3 |
| Format 2 | H-1 comparison | 2.43% | 31 | 6 |
| Format 2 | H-1 comparison | 2.43% | 42 | 10 |
| Format 2 | H-1 comparison | 2.43% | 52 | 14 |
| Format 2 | H-1 comparison | 2.43% | 63 | 21 |
| Format 2 | H-1 comparison | 2.43% | 70 | 28 |
| Format 2 | H-2 invention | 2.107% | 19 | 1 |
| Format 2 | H-2 invention | 2.107% | 30 | 2 |
| Format 2 | H-2 invention | 2.107% | 39 | 3 |
| Format 2 | H-2 invention | 2.107% | 52 | 6 |
| Format 2 | H-2 invention | 2.107% | 70 | 10 |
| Format 2 | H-2 invention | 2.107% | 70 | 14 |
| Format 2 | H-2 invention | 2.107% | 71 | 21 |
| Format 2 | H-2 invention | 2.107% | 75 | 28 |

To measure the rate at which the coatings harden papers with equal molar amounts of hardener H-1 or H-2 were imbibed in distilled water and the amount of water pick up per unit area was determined. As the coatings harden, they pick up less water. Coatings that contain hardener H-2 clearly harden at a much faster rate than coatings with hardener H-1. The data in Table 8 demonstrate this that H-2 hardens at a faster rate.

TABLE 8

| Coating | Hardener | % Hardener Based on Total Gel | Mgs/ft$^2$ of Water Pickup | Days After Coating |
|---|---|---|---|---|
| Format 2 | H-1 comparison | 2.43% | 2200 | 1 |
| Format 2 | H-1 comparison | 2.43% | 1890 | 2 |
| Format 2 | H-1 comparison | 2.43% | 1740 | 3 |
| Format 2 | H-1 comparison | 2.43% | 1580 | 6 |
| Format 2 | H-1 comparison | 2.43% | 1490 | 10 |
| Format 2 | H-1 comparison | 2.43% | 1450 | 14 |
| Format 2 | H-1 comparison | 2.43% | 1400 | 21 |
| Format 2 | H-1 comparison | 2.43% | 1390 | 28 |
| Format 2 | H-2 invention | 2.107% | 1810 | 1 |
| Format 2 | H-2 invention | 2.107% | 1620 | 2 |
| Format 2 | H-2 invention | 2.107% | 1540 | 3 |
| Format 2 | H-2 invention | 2.107% | 1460 | 6 |
| Format 2 | H-2 invention | 2.107% | 1410 | 10 |
| Format 2 | H-2 invention | 2.107% | 1390 | 14 |
| Format 2 | H-2 invention | 2.107% | 1350 | 21 |
| Format 2 | H-2 invention | 2.107% | 1330 | 28 |

Example 5

Monochrome coatings were made using Coating Format 3. The magenta dispersion used was MDF-2. Hardener H-1 was coated at 0.985%, 1.97%, and 2.96% (weight of hardener/weight of total gelatin). Hardener H-2 was coated at 0.855%, 1.71%, and 2.57% (weight of hardener/weight of total gelatin). The low, middle, and high levels of H-1 and H-2 represent equivalent molar amounts. Coated samples were processed in an RA-4 color paper process. The densities of the low density areas were read using Status A filters. The coatings were placed in a high temperature dark oven, 75° C., 50% RH for 28 days. The samples were again measured after 28 days with Status A filters. The largest increase in density was yellow in appearance and was measured using a status A blue filter. Results contained in Table 9 indicate that both H-1 and H-2 have a correlation with higher blue stain gains in darkness tests as the weight % hardener is increased. However, hardener H-2 shows an advantage because the stains associated with it are always lower than those associated with equal molar amounts of H-1, and the rate of increase in blue density gain as hardener level is increased is much lower with H-2.

TABLE 9

| Coating | Hardener | Wt % Hardener Based on Total Gel | $D_B$ Dmin Fresh Process | $D_B$ Dmin After 28D/ 75° C./ 50% RH |
|---|---|---|---|---|
| Coating Format 3 (MDF-2) | H-1 comparison | .985% | .10 | .27 |
| Coating Format 3 (MDF-2) | H-1 comparison | 1.97% | .10 | .36 |
| Coating Format 3 (MDF-2) | H-1 comparison | 2.96% | .10 | .43 |
| Coating Format 3 (MDF-2) | H-2 invention | .855% | .10 | .21 |
| Coating Format 3 (MDF-2) | H-2 invention | 1.71% | .10 | .23 |
| Coating Format 3 (MDF-2) | H-2 invention | 2.57% | .10 | .25 |

Example 6

Monochrome coatings were made using Coating Format 3. The magenta dispersions used in this experiment were made using magenta coupler M-1 and diluting the oil phase of the dispersion with Tris(2-ethylhexyl)phosphate so that the coupler comprised either 33%, 30.5%, 27.75%, 25%, or 20% of the total oil phase components. Table 10 contains a description of the dispersion oil phases used in this example.

TABLE 10

| | MDF-2 | MDF-5 | MDF-6 | MDF-7 | MDF-8 |
|---|---|---|---|---|---|
| Magenta Coupler (M-1) | 1.0 | 1.0 | 1.0 | 1.0 | 1.0 |
| Tris(2-ethyl-hexyl)phosphate | .964 | 1.243 | 1.567 | 1.964 | 2.964 |
| 2-(2-butoxy-ethoxy)ethylacetate | .162 | .162 | .162 | .162 | .162 |
| Stabilizer Compound (ST-1) | .774 | .774 | .774 | .774 | .774 |
| HQ-1 | .10 | .10 | .10 | .10 | .10 |
| Coupler M-1, % of Total Oil Phase | 33% | 30.5% | 27.75% | 25% | 20% |

Coatings were made with all dispersions using either hardener H-1 (comparison) or hardener H-2 (invention). The hardeners were coated at equal molar amounts, H-1 at 2.43% of total coated gelatin, or hardener H-2 at 2.107% of total coated gelatin. Coated samples were exposed in a stepwise manner on a 1B sensitometer. The papers were processed in color paper process RA-4. On one set of coatings the densities of the low density area were read using Status A filters. The coatings were placed in a high temperature dark oven, 75° C., 50% RH for 28 days. The largest increase in density was yellow in appearance and was measured using a Status A blue filter. Results contained in Table 11 indicate that with hardener H-1, as the coupler dispersion is diluted with Tris(2-ethylhexyl)phosphate from 33% to 20% of the total oil phase, the amount of yellow discoloration in the low density area formed in the dark oven test increases. When hardener H-2 is coated with the same dispersions, the amount of yellow discoloration is less, and it does not increase substantially until the coupler is diluted to 20% of the weight of the total oil phase. The reduction in yellow discoloration with the combination of hardener H-2 with dispersion Formula MDF-2, MDF-5, MDF-6, MDF-7, and MDF-8 is very significant because the magenta dye formed from the photographic coatings is shown to be more stable to light as the coupler M-1 is diluted with Tris(2-ethylhexyl) phosphate. Table 11 also contains data from coatings that were exposed and processed as stated in this example. The coatings were submitted for light fade tests. The light intensity was 50 klux of simulated daylight for 14 continuous days. Densities of the samples measured before and after the light fade test. The data, also included in Table 11, show that as the dispersion oil phase is diluted with Tris(2-ethylhexyl)phosphate, the light fade of the dye from magenta coupler is improved. By using hardener H-2 in combination with the diluted dispersions, it is possible to improve the dye light fade and not have a coating that has increased discoloration in the low density areas in high temperature dark keeping tests.

TABLE 11

| Coating | Dispersion Oil Phase | Hardener | $D_B$ Dmin Fresh Process | $D_B$ Dmin 28 Days/ 75° C./ 50% RH | 2 wk/50 Klux DL Light Fade Dg Loss From 1–0 |
|---|---|---|---|---|---|
| Format 3 | MDF-2 | H-1 | .10 | .27 | −.22 |
| Format 3 | MDF-5 | H-1 | .10 | .32 | −.21 |
| Format 3 | MDF-6 | H-1 | .10 | .37 | −.19 |
| Format 3 | MDF-7 | H-1 | .10 | .41 | −.17 |
| Format 3 | MDF-8 | H-1 | .10 | .44 | −.15 |
| Format 3 | MDF-2 | H-2 | .10 | .23 | −.22 |
| Format 3 | MDF-5 | H-2 | .10 | .22 | −.21 |
| Format 3 | MDF-6 | H-2 | .10 | .24 | −.20 |
| Format 3 | MDF-7 | H-2 | .10 | .24 | −.18 |
| Format 3 | MDF-8 | H-2 | .10 | .32 | −.15 |

H-1 - Comparison
H-2 - Invention

Another advantage of the combination hardener H-2 and the dispersions of coupler M-1 was observed in measuring the hue of the magenta dye. Coatings described were exposed using a 0–3.0 log E continuous exposure tablet and processed in an RA-4 paper process. The hue of the magenta dyes was measured so that at the lambda max of the dye, the density was exactly 1.0. For improvement in color quality it is desirable to have dyes that have narrow dye spectra. A common method of comparing the dye hues is to state their width at one half the density of the lambda max. The bandwidth of the dyes from these coatings was measured at 0.50 density. For preferred color quality, it is desirable to have the bandwidth of the dye at 0.50 density less than 99.9 nanometers. Another advantage of this invention is that when hardener H-2 is combined with dispersions that have a dilute oil phase like MDF-7 and MDF-8, a bandwidth less than 99.9 nanometers is obtained. The data are included in Table 12.

TABLE 12

| Coating | Dispersion Oil Phase | Hardener | Bandwidth @ .50 Density |
|---|---|---|---|
| Format 3 | MDF-5 | H-1 | 106.4 |
| Format 3 | MDF-7 | H-1 | 102.4 |
| Format 3 | MDF-8 | H-1 | 99.9 |
| Format 3 | MDF-5 | H-2 | 106.5 |
| Format 3 | MDF-7 | H-2 | 99.5 |
| Format 3 | MDF-8 | H-2 | 95.9 |

H-1 - Comparison
H-2 - Invention

| Coating Format 1 | |
|---|---|
| Layer 1: Blue Sensitive Layer | |
| Gelatin | 1.530 g/m$^2$ |
| Blue Sensitive Silver | 0.280 g Ag/m$^2$ |
| Y-1 | 1.080 g/m$^2$ |
| Dibutyl phthalate | 0.260 g/m$^2$ |
| 2-(2-butoxyethoxy)ethyl acetate | 0.260 g/m$^2$ |
| Layer 2: Interlayer | |
| Gelatin | 0.753 g/m$^2$ |
| Dioctyl hydroquinone | 0.094 g/m$^2$ |
| Dibutyl phthalate | 0.282 g/m$^2$ |
| Disodium 4,5 Dihydroxy-m-benzenedisulfonate | 0.065 g/m$^2$ |
| Layer 3: Green Sensitive Layer | |
| Gelatin | 1.270 g/m$^2$ |
| Green Sensitive Silver | 0.263 g Ag/m$^2$ |
| M-1 | 0.389 g/m$^2$ |
| Dibutyl phthalate | 0.195 g/m$^2$ |
| 2-(2-butoxyethoxy)ethyl acetate | 0.058 g/m$^2$ |
| ST-1 | 0.166 g/m$^2$ |
| Dioctyl hydroquinone | 0.039 g/m$^2$ |
| Layer 4: UV Interlayer | |
| Gelatin | 0.484 g/m$^2$ |
| UV-1 | 0.028 g/m$^2$ |
| UV-2 | 0.159 g/m$^2$ |
| Dioctyl hydroquinone | 0.038 g/m$^2$ |
| 1,4-Cyclohexylenedimethylene bis(2-ethylhexanoate) | 0.062 g/m$^2$ |
| Layer 5: Red Sensitive Layer | |
| Gelatin | 1.389 g/m$^2$ |
| Red Sensitive Silver | 0.187 g Ag/m$^2$ |
| C-1 | 0.424 g/m$^2$ |
| Dibutyl phthalate | 0.414 g/m$^2$ |
| UV-2 | 0.272 g/m$^2$ |
| 2-(2-butoxyethoxy)ethyl acetate | 0.035 g/m$^2$ |
| Dioctyl hydroquinone | 0.004 g/m$^2$ |
| Layer 6: Upper UV | |
| Gelatin | 0.484 g/m$^2$ |
| UV-1 | 0.028 g/m$^2$ |
| UV-2 | 0.159 g/m$^2$ |
| Dioctyl hydroquinone | 0.038 g/m$^2$ |
| 1,4-Cyclohexylenedimethylene bis(2-ethylhexanoate) | 0.062 g/m$^2$ |
| Layer 7: SOC | |
| Gelatin | 1.076 g/m$^2$ |
| Polydimethylsiloxane | 0.027 g/m$^2$ |
| Surfactant | 0.016 g/m$^2$ |

| Layer 1: Blue Sensitive Layer | |
|---|---|
| Gelatin | 1.319 g/m$^2$ |
| Blue Sensitive Silver | 0.203 g Ag/m$^2$ |
| Y-2 | 0.418 g/m$^2$ |
| Dibutyl phthalate | 0.285 g/m$^2$ |
| ST-3 | 1.393 g/m$^2$ |

-continued

Layer 1: Blue Sensitive Layer

Layer 2: Interlayer

| | |
|---|---|
| Gelatin | 0.650 g/m$^2$ |
| Dioctyl hydroquinone | 0.057 g/m$^2$ |
| Dibutyl phthalate | 0.163 g/m$^2$ |
| Disodium 4,5 Dihydroxy-m-benzenedisulfonate | 0.065 g/m$^2$ |
| Irganox 1076 ™ | 0.016 g/m$^2$ |

Layer 3: Green Sensitive Layer

| | |
|---|---|
| Gelatin | 1.087 g/m$^2$ |
| Green Sensitive Silver (Green EM-1) | 0.172 g Ag/m$^2$ |
| M-1 | 0.365 g/m$^2$ |
| Tris(2-ethoxyethyl) phosphate | 0.685 g/m$^2$ |
| 2-(2-butoxyethoxy)ethyl acetate | 0.059 g/m$^2$ |
| ST-1 | 0.404 g/m$^2$ |
| Dioctyl hydroquinone | 0.037 g/m$^2$ |

Layer 4: UV Interlayer

| | |
|---|---|
| Gelatin | 0.849 g/m$^2$ |
| UV-1 | 0.062 g/m$^2$ |
| UV-2 | 0.353 g/m$^2$ |
| Dioctyl hydroquinone | 0.085 g/m$^2$ |
| 1,4-Cyclohexylenedimethylene bis(2-ethyl-hexanoate) | 0.138 g/m$^2$ |

Layer 5: Red Sensitive Layer

| | |
|---|---|
| Gelatin | 1.198 g/m$^2$ |
| Red Sensitive Silver | 0.190 g Ag/m$^2$ |
| C-1 | 0.365 g/m$^2$ |
| Dibutyl phthalate | 0.358 g/m$^2$ |
| UV-2 | 0.235 g/m$^2$ |
| 2-(2-butoxyethoxy)ethyl acetate | 0.030 g/m$^2$ |
| Dioctyl hydroquinone | 0.003 g/m$^2$ |

-continued

Layer 1: Blue Sensitive Layer

Layer 6: UV Overcoat

| | |
|---|---|
| Gelatin | 0.645 g/m$^2$ |
| UV-1 | 0.048 g/m$^2$ |
| UV-2 | 0.277 g/m$^2$ |
| Dioctyl hydroquinone | 0.067 g/m$^2$ |
| 1,4-Cyclohexylenedimethylene bis(2-ethyl-hexanoate) | 0.108 g/m$^2$ |

Layer 7: SOC

| | |
|---|---|
| Gelatin | 0.697 g/m$^2$ |
| Polydimethylsiloxane | 0.027 g/m$^2$ |
| Surfactants | 0.0186 g/m$^2$ |

| LAYER | COMPONENT | AMOUNT |
|---|---|---|
| 3 | Surfactant | 0.004 g/m$^2$ |
| | Gelatin | 1.076 g/m$^2$ |
| 2 | UV-1 | 0.113 g/m$^2$ |
| | UV-2 | 0.640 g/m$^2$ |
| | Dioctylhydroquinone | 0.086 g/m$^2$ |
| | 1,4-Cyclohexylenedimethylene bis(2-ethyl-hexanoate) | 0.251 g/m$^2$ |
| | Gelatin | 1.399 g/m$^2$ |
| 1 | M-1 (coated from MDF-2) | 0.414 g/m$^2$ |
| | Green Sensitive Silver | 0.258 g Ag/m$^2$ |
| | Gelatin | 1.55 g/m$^2$ |
| Support | Polyethylene laminated paper with $TiO_2$/ZnO in the polyethylene laminated in the first layer side, precoated with 3.23 g/m$^2$ gelatin | |

APPENDIX 1,1'-[oxybis(methylenesulfonyl)]bis-ethene H-1

1.1'-[(methylenebis(sulfonyl)]bis-ethene H-2

M-1

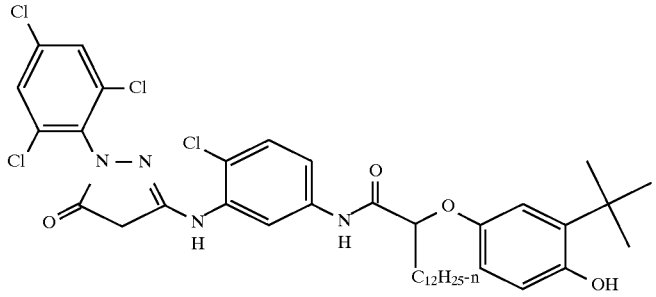

M-2

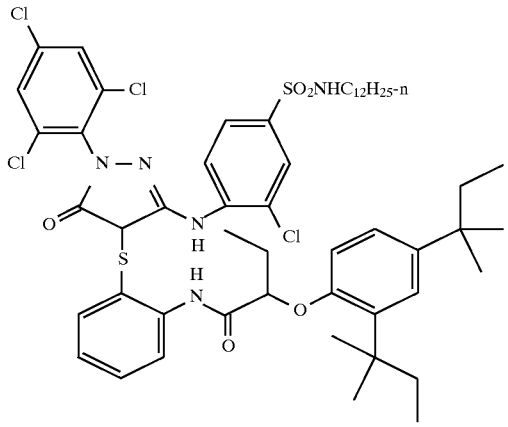

-continued
APPENDIX
M-3
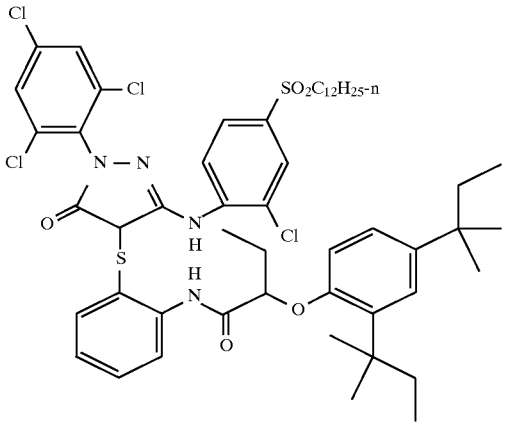
HQ-1
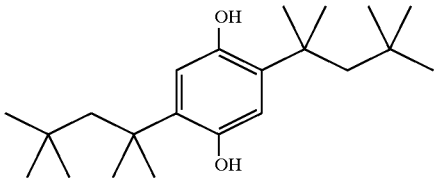
HQ-2
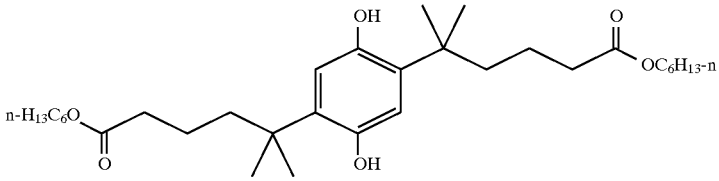
ST-1
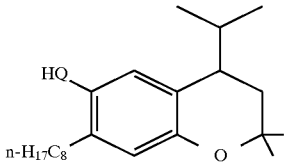
ST-2
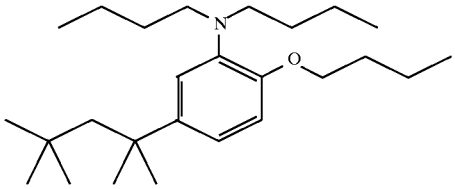
Y-1
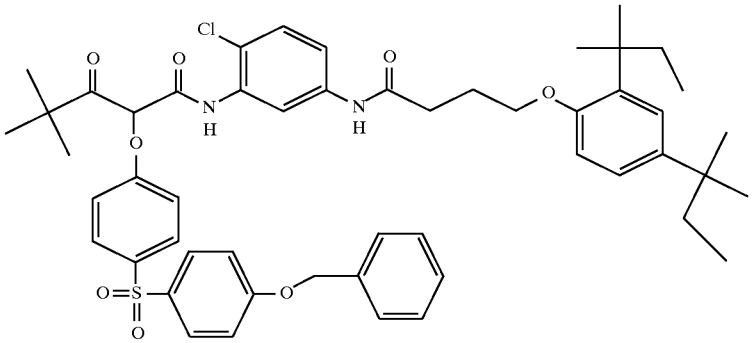

-continued

APPENDIX

UV-1

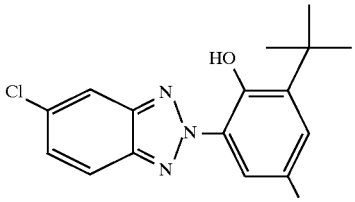

UV-2

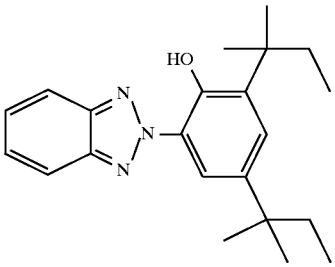

C-1

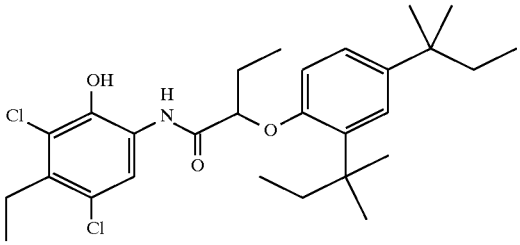

Y-2

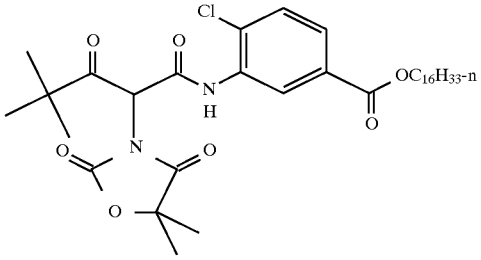

ST-3

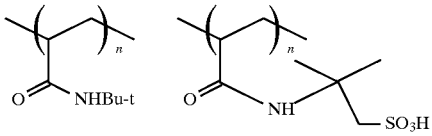

(99:1) mw = 75–80,000

The invention has been described in detail with particular reference to preferred embodiments thereof, but it will be understood that variations and modifications can be effected within the spirit and scope of the invention.

We claim:

1. A photographic element wherein at least one magenta color forming layer comprises a coupler of Formula I Formula I

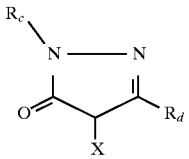

$R_c$ is a substituent; $R_d$ is anilino, carbonamide, ureido, carbamoyl, or N-heterocyclic group; X is hydrogen or a split off group displaceable by oxidized developer;

a hardener of Formula II,

Formula II $$\{CH_2{=}CH{-}X'\}_m{-}Y$$

where

X'=CO, $OSO_2$, $SO_2$, $SO_2NR_2$, and $CONR_2$; wherein when X' is $SO_2NR_2$ or $CONR_2$, then each R is hydrogen or alkyl;

Y=C1–C10 alkyl or aryl or substituted C1–C10 alkyl or substituted aryl group;

m=1, 2, 3, or 4;

a permanent solvent of Formula IIIa

IIIA

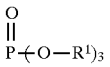

wherein:

$R^1$=alkyl or substituted alkyl, wherein said coupler of Formula I and solvent of Formula IIIa are provided in amounts such that the coupler comprises between about 20 and 40% by weight of the total of the coupler and oil phase components wherein said element further comprises a chromanol stabilizer.

2. The photographic element of claim 1 wherein the coupler of said Formula I comprises

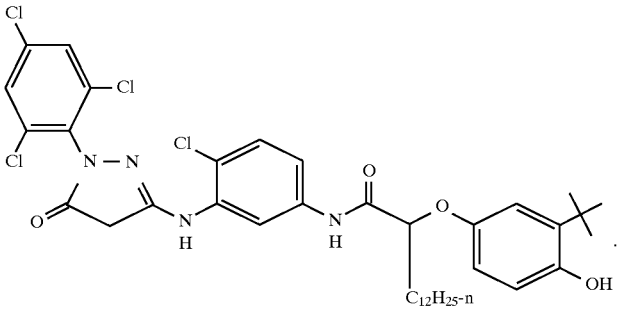

3. The photographic element of claim 1 wherein said permanent solvent comprises tris(2-ethylhexyl)phosphate.

4. The photographic element of claim 1 wherein in said hardener of Formula II, X=$SO_2$, Y=methylene, and m=2.

5. The photographic element of claim 1 wherein said coupler comprises between about 20 and about 40 percent by weight of the total weight of the coupler and oil phase components.

6. The photographic element of claim 1 wherein the layer further comprises antioxidant, scavenger, and auxiliary coupler solvent.

7. The photographic element of claim 1 wherein said chromanol comprises

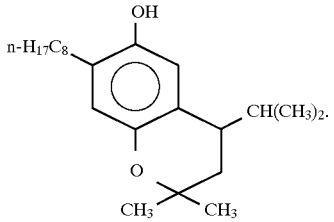

8. The photographic element of claim 6 wherein said auxiliary solvent comprises low boiling solvents.

9. The photographic element of claim 8 wherein said auxiliary solvent comprises 2-(2-butoxyethoxy)ethyl acetate.

10. The photographic element of claim 6 wherein said stabilizer comprises an aromatic tertiary amine.

11. The photographic element of claim 10 wherein said aromatic tertiary amine comprises

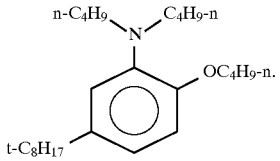

12. The photographic element of claim 1 wherein said element is a color paper.

* * * * *